United States Patent [19]

Collins et al.

[11] Patent Number: 4,493,382

[45] Date of Patent: Jan. 15, 1985

[54] VEHICLE-MOUNTED EARTH DRILLING APPARATUS

[75] Inventors: Robert A. Collins, LeMars, Iowa; Timothy A. Lewis, Aurora, Ill.

[73] Assignee: Gus Pech Manufacturing Co., LeMars, Iowa

[21] Appl. No.: 526,378

[22] Filed: Aug. 25, 1983

[51] Int. Cl.[3] ..... E21B 7/02

[52] U.S. Cl. ..... 175/206; 175/207

[58] Field of Search ..... 175/206, 207, 209, 66, 175/217; 173/22, 28; 296/37.6, 24 R

[56] References Cited

U.S. PATENT DOCUMENTS

| | | | |
|---|---|---|---|
| 1,838,344 | 12/1931 | Wilson | 296/37.6 |
| 2,001,502 | 5/1935 | Satre | 175/88 |
| 2,206,922 | 7/1940 | Smith | 175/88 |
| 2,621,022 | 12/1952 | Bardill | 175/217 |
| 2,786,651 | 3/1957 | Mickle | 175/206 |
| 2,807,441 | 9/1957 | Sewell | 173/28 |
| 2,923,151 | 2/1960 | Engle et al. | 175/206 |
| 3,633,687 | 1/1972 | West | 175/206 |
| 3,835,940 | 9/1974 | Winter, Jr. | 175/85 |

FOREIGN PATENT DOCUMENTS

| | | | |
|---|---|---|---|
| 55-01931 | 9/1980 | Japan | 173/22 |
| 7713169 | 6/1979 | Sweden | 173/22 |

*Primary Examiner*—James A. Leppink
*Assistant Examiner*—Hoang C. Dang
*Attorney, Agent, or Firm*—E. Robert Newman

[57] ABSTRACT

An "L" shaped mud pit longitudinally and horizontally hinges at an upper edge of a wall panel thereof to a portion of a vehicle frame, or an extension thereof, such that when lowered it is in ground-supported, horizontal position convenient with respect to the hole to be drilled and when raised it is in a storage-transport vertical position in which it is in line with the adjacent side of the vehicle, and its rearward portion is above the vehicle rear tire. A centrally located divider wall panel enables liquid to travel from the rear of the mud pit forward and then back again to the rear thereof where a removable extension to the mud pump intake pipe is located. Screens, adjustable leveling pads, and drain and cleanout plugs are also provided.

17 Claims, 5 Drawing Figures

VEHICLE-MOUNTED EARTH DRILLING APPARATUS

TECHNICAL FIELD

This invention relates to vehicle-mounted earth drills which have provisions for circulating medium, such as fluid, into the hole as it is drilled in order to remove material from the hole. The discharging liquid and material, primarily mud, is conveyed into a mud pit where it is confined, observed, and screened. More particularly, the present invention relates to an apparatus which includes a mud pit hingedly mounted to the vehicle for a transport and storage mode in the vertical position and an operation mode in the horizontal position.

BACKGROUND ART

Originally a mud pit consisted of a shallow excavated hole located alongside a vehicle-mounted earth drill. After filling such a pit with fluid, the fluid was pumped through the drill stem into the hole, forced upwards around the drill stem into a canal in the ground through which it flowed back to the pit. The pit provided a controlled area to contain a supply of fluid, a facility from which rock and debris could be observed and removed and a surge vessel for recirculating fluid.

Over time, excavated mud pits have generally been replaced by portable tubs which eliminate excavating and refilling. In addition a portable tub reduces disfiguration of the area as well as water loss into the subsoil. Such tubs are generally carried atop the drill mast when in its horizontal, transport position. Upon arrival at the site for drilling a hole, they are manually lowered to the rear of the drilling apparatus such that an opening in their receiving end surrounds the drill stem. Such portable mud pits may have provisions for sectional screening of the liquid as it moves from the receiving end of the pit to the discharge end. A disadvantage of portable pits is the longer distance between the discharge end and the pump. Fluid must be lifted this additional distance and cavitation may be created in the long flexible suction hose.

Typical mud pits of this type generally range in length from seven to fourteen feet, in width from two to four feet, and in height from one to two feet. Physically, they are impractical for fewer than two persons to handle. Often it is necessary for a third, or even a fourth person to be present at job site when the mud pit is to be loaded or unloaded. Due to its bulk, weight, and unwieldy shape, the portable mud pit is highly susceptible to denting, breaking and bending. Such damage later interferes with liquid flow, causes leaks and hampers the functioning of screens and inlet pipe.

In addition to the mud pit itself, loading and unloading it from the mast subjects the drill and its accoutrements, as well as ancillary equipment and supplies, to frequent and costly damage. Also, care must be taken to be sure over-the-road height limitations are met and there is always a risk that the mud pit will come loose while being transported.

DISCLOSURE OF THE INVENTION

An object of the present invention is a provision of an improved vehicle-mounted earth drill and mud pit apparatus.

Another object is to provide a mud pit which is an integral part of a vehicle-mounted earth drill.

A further object of the invention is the provision of a mud pit which is longitudinally hingedly attached to the frame of a vehicle-mounted earth drill.

Another object is to provide a self-positioning mud pit which can be practically moved from storage and transport mode to operation mode and back again by a single person.

A still further object of an invention is to provide a mud pit for a vehicle-mounted earth drill which is transported, stored, and moved to operation position in a manner which eliminates most chances for damage to the mud pit vehicle, drill, and ancillary items.

A still further object of the invention is to provide a vehicle-mounted earth drill and mud pit apparatus having a sturdier construction with additional amenities such as screens, adjustable supporting legs, and cleanout plugs without adding weight which would be otherwise impractical.

Yet another object is the provision of a vehicle-mounted earth drill carrying a mud pit for which legal widths and height restrictions are guaranteed.

In a more general sense, it is an object of this invention to hinge the upper edge of one wall of an "L" shaped mud pit horizontally and longitudinally to a location on the vehicle-mounted earth drill frame which is above ground level a distance approximately equal to the height of the mud pit wall panels and inboard from a side of the vehicle approximately the same distance. The mud pit is also located such that the unattached leg of the "L" shape will be above the rear tire when in transport mode and near the rear of the vehicle for receipt of liquid from the hole being drilled when in operation mode. The mud pit is fitted with a centrally located divider panel which will cause circulating liquid to take a longitudinally-oriented course towards the front of the vehicle and then return in a parallel course towards the rear of the vehicle to a point where it is adjacent to the pump for return to the drill stem.

Provision is also made for a winch to move the mud pit between its vertical, transport-storage position to its horizontal, operation position. Lightweight accessories easily installed by a single person include a pump intake pipe for reaching near the bottom of the mud pit, a corner screen to surround the pump intake pipe, and a portable trough for gravity feed from the hole being drilled to the receiving end of the mud pit.

These and other objects, advantages and novel features of the present invention will become apparent from the following detailed description of the invention when considered in conjunction with the accompanying drawings.

BEST MODE FOR CARRYING OUT INVENTION

Figure 1:
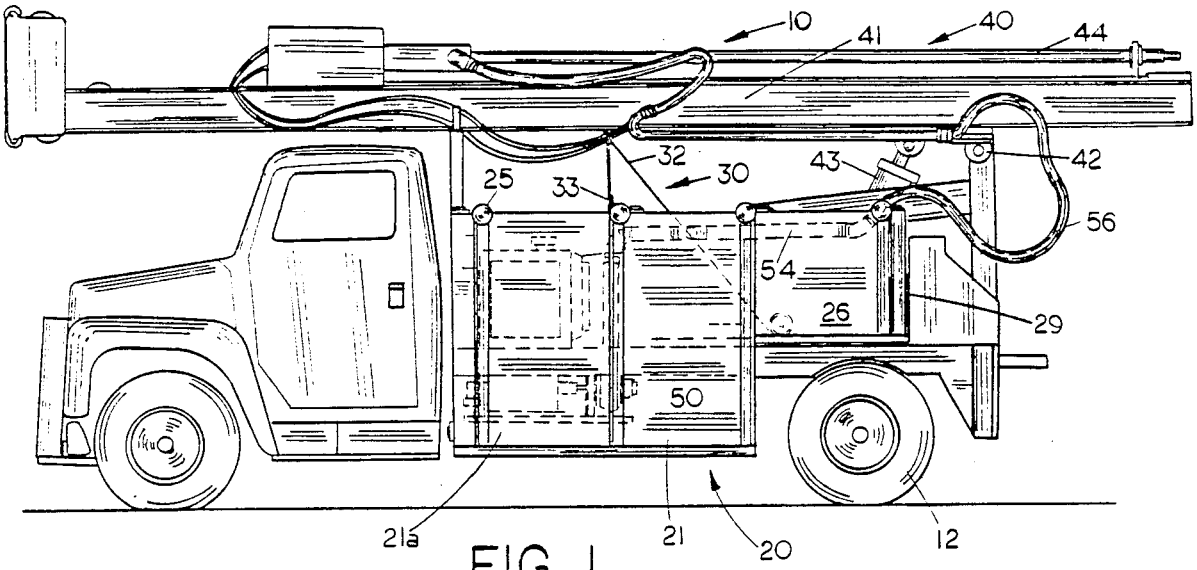
FIG. 1 is a side elevation view of the present invention with the drill stem mast and mud pit in the transport mode.

Referring now to the drawings, wherein like reference numerals designate identical or corresponding parts throughout the several views, and more particularly to FIG. 1, the present invention is shown in transport-storage mode and is designated generally at 10. "L" shaped mud pit assembly 20 is seen thereon to be vertically oriented, exposing the underside 21*a*, of its bottom panel 21, to view.

Figure 2:
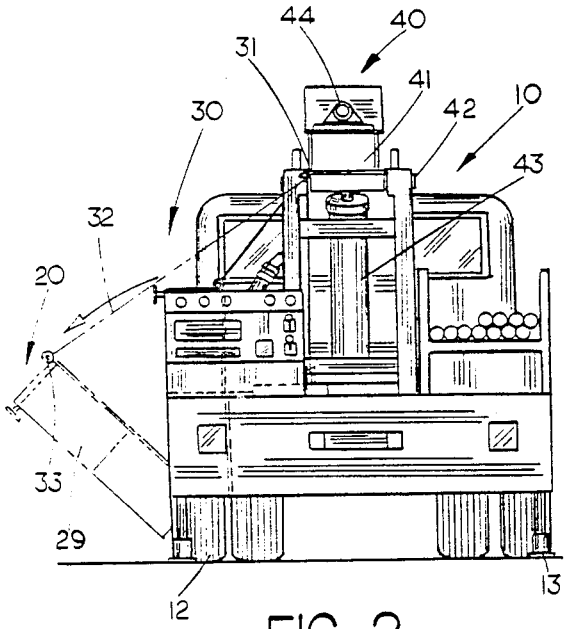
FIG. 2 is a rear elevational view showing the mud pit in phantom lines being lowered to the horizontal, operational mode.

As seen in FIG. 2, mud pit assembly 20 is lowered and raised between its transport-storage position to a ground-supported, operation position (see FIGS. 3, 4, and 5) by the use of winch assembly 30. First, pulley 31 is removably and swivelly connected, in a well known manner, to a fixture (not shown) on mast 41 of mast and drill assembly 40. Cable 32 is then connected, in a well known manner, to loop 33, after which mud pit assembly 20 is lowered. Mast and drill assembly 40 may then be pivoted about hinge 42 by cylinder 43 (see FIGS. 1 and 4) to raise it to the vertical, operation mode. To return mud pit assembly 20 to its transport-storage position these steps are reversed.

Figure 5:
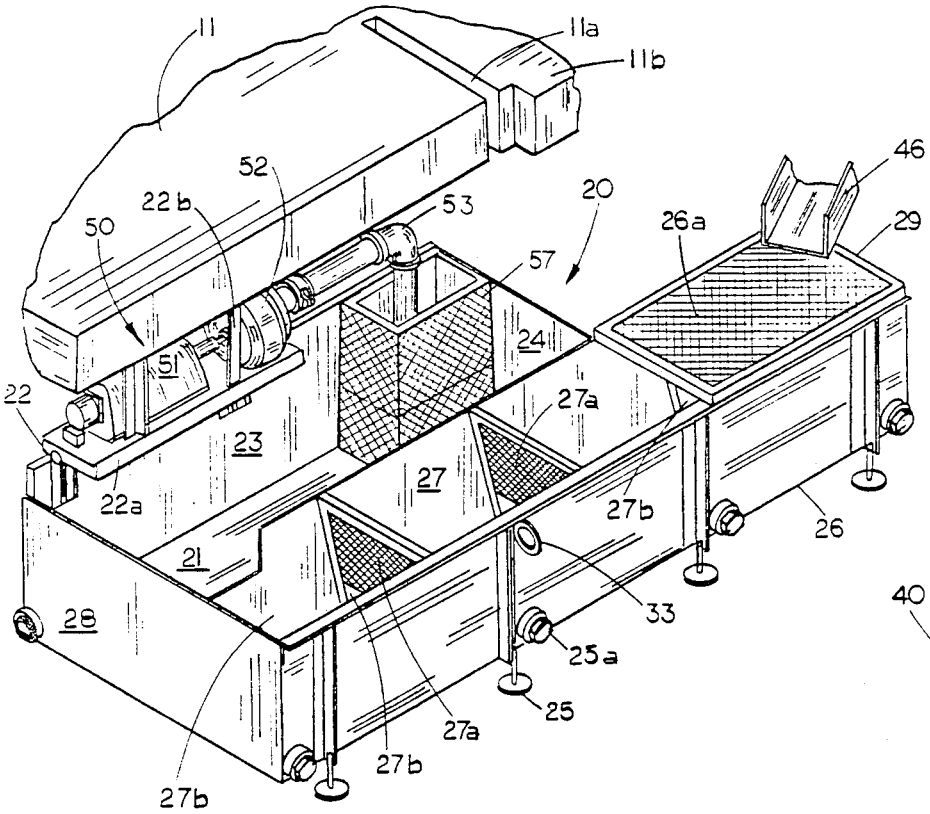
FIG. 5 is an enlarged perspective partial view of the mud pit in the horizontal, operational mode.

Referring now to FIG. 5, whereon mud pit assembly 20 is shown in its ground-supported, horizontal position and winch assembly 30 has been disconnected from loop 33, mud pit assembly 20 is seen to pivot about horizontal hinge assembly 22. Hinge assembly 22 is seen to connect mud pit assembly 20 along the upper edge of its inner wall panel 23 along a line which is parallel to the longitudinal orientation of vehicle-mounted earth drill 10 to platform 22*a*. Platform 22*a* is suspended by members 22*b* from deck 11 of vehicle-mounted earth drill 10. Hinge assembly 22 is located a distance above the ground and a distance inboard of the side of vehicle-mounted earth drill 10 approximately equal to the height of inner wall panel 23. This location of horizontal hinge assembly 22 has two advantages. It permits mud pit assembly 20 to rest substantially on the ground when lowered by winch assembly 30 and to have its bottom wall 21 adjacent the outboard most portions of vehicle-mounted earth drill 10, including any ancillary equipment or supplies, when in its raised, transport-storage position. A plurality of adjustable leveling pads 25 are available to establish the desired level of bottom panel 21. The powered lowering and raising of mud pit assembly 20 permit the addition of amenities, such as pads 25, to the mud pit without creating undue weight problems.

Deck 11 is provided with notch 11*a* for accommodating rear wall panel 24. Rear wall panel 24 is the rearward most wall of what would be the vertical leg of the "L" shape of mud pit assembly as seen by one facing vehicle-mounted earth drill 10 and looking down upon mud pit assembly 20 when it is in its horizontal, operation position. The portion 26 of mud pit assembly 20 which would be the projection of its horizontal leg when so viewed is sized so as to pivot above rear deck portion 11*b* and rear tire 12 (see FIGS. 1 and 4) when raised to its vertical, transport-storage position.

Portion 26 of mud pit assembly 20, being located as described above, is in a position to conveniently receive fluid from the hole being drilled by drill stem 44. Additionally, mud pit assembly 20 has a divider wall panel 27 which runs parallel to hinge assembly 22, along the intersecting plane between what would be the horizontal leg and vertical leg of the "L" shape of mud pit assembly 20, to a point short of the forward wall panel 28 thereof. It should be appreciated that the shape, orientation, and location of mud pit assembly 20 enable fluid flow from a point on portion 26 into which fluid coming from the hole being drilled enters therein to travel an optimum length forward along divider wall panel 27 and then rearward along the other side thereof to a point along wall panel 24 where removable intake pipe 53 of pump assembly 50 is located.

Figure 3:
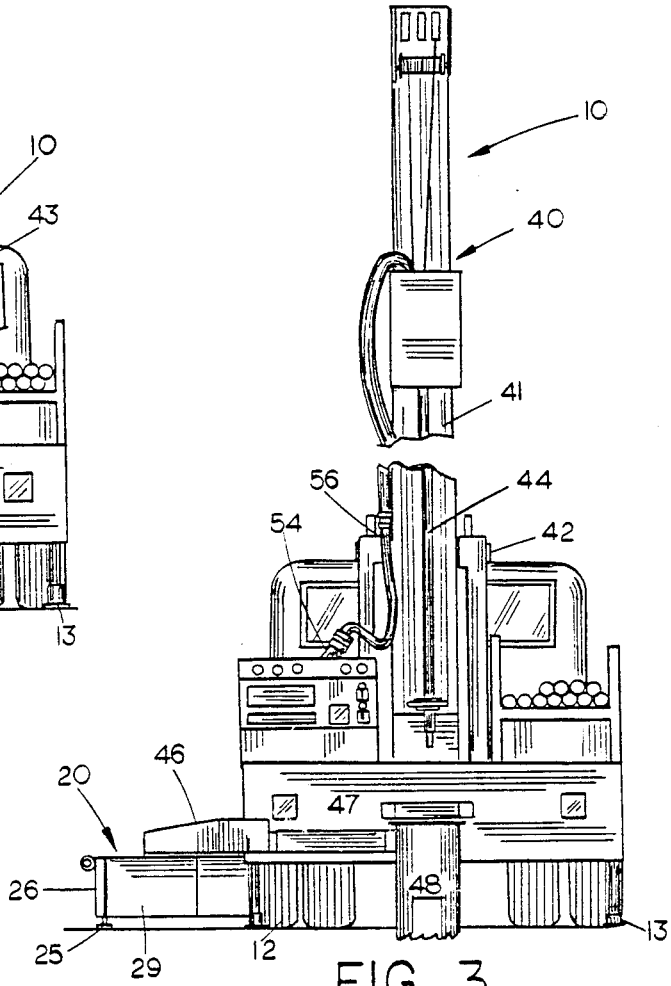
FIG. 3 is a rear elevational view of the present invention showing the drill stem mast in the vertical, operational mode and the mud pit in the horizontal, operational mode.

To transport fluid from the hole being drilled to mud pit assembly 20, portable trough 46 is connected at its rearward most end through flexible hose 47 to riser pipe 48 which surrounds drill stem 44 (see FIG. 3). Its forward-most end is rested upon either the rearward most wall 29 of mud pit assembly 20 or upon screen 26*a* (See FIG. 5). Gravity flow is effected through trough 46 by maintaining its rearward most end at a higher level than its foward-most end.

A plurality of screens 27*a* for trapping material, may be employed along the fluid flow path through mud pit assembly 20 as desired (see FIG. 5). Thus, foreign matter is segregated for observing and testing and removed from the fluid which will re-enter pump assembly 50. Located below screens 27*a* and at other locations, as desired, lower divider panels 27*b* serve to separate the flow path into sections. The sections serve as a series of settling tanks which can be emptied and cleaned through appropriately located drain and plug assemblies 25*a*.

Pump assembly 50 (see FIGS. 1, 4 and 5) is supported on top of and affixed to platform 22*a*. It is comprised of a motor 51, a fluid pump 52, an intake pipe 53, an outlet pipe 54, and a flexible hose 56. As explained hereinabove, intake pipe 53 is located near the corner of mud pit assembly 20 at which wall panels 23 and 24 intersect. However, intake pipe 53 is removably connected to the pump in a well known manner, in order not to be in the way of wall panel 23 when mud pit assembly 20 is lowered and raised. To further insure that no material which might injure fluid pump 52 can enter through intake pipe 53, a removable, portable corner screen unit 57 is provided.

Figure 4:
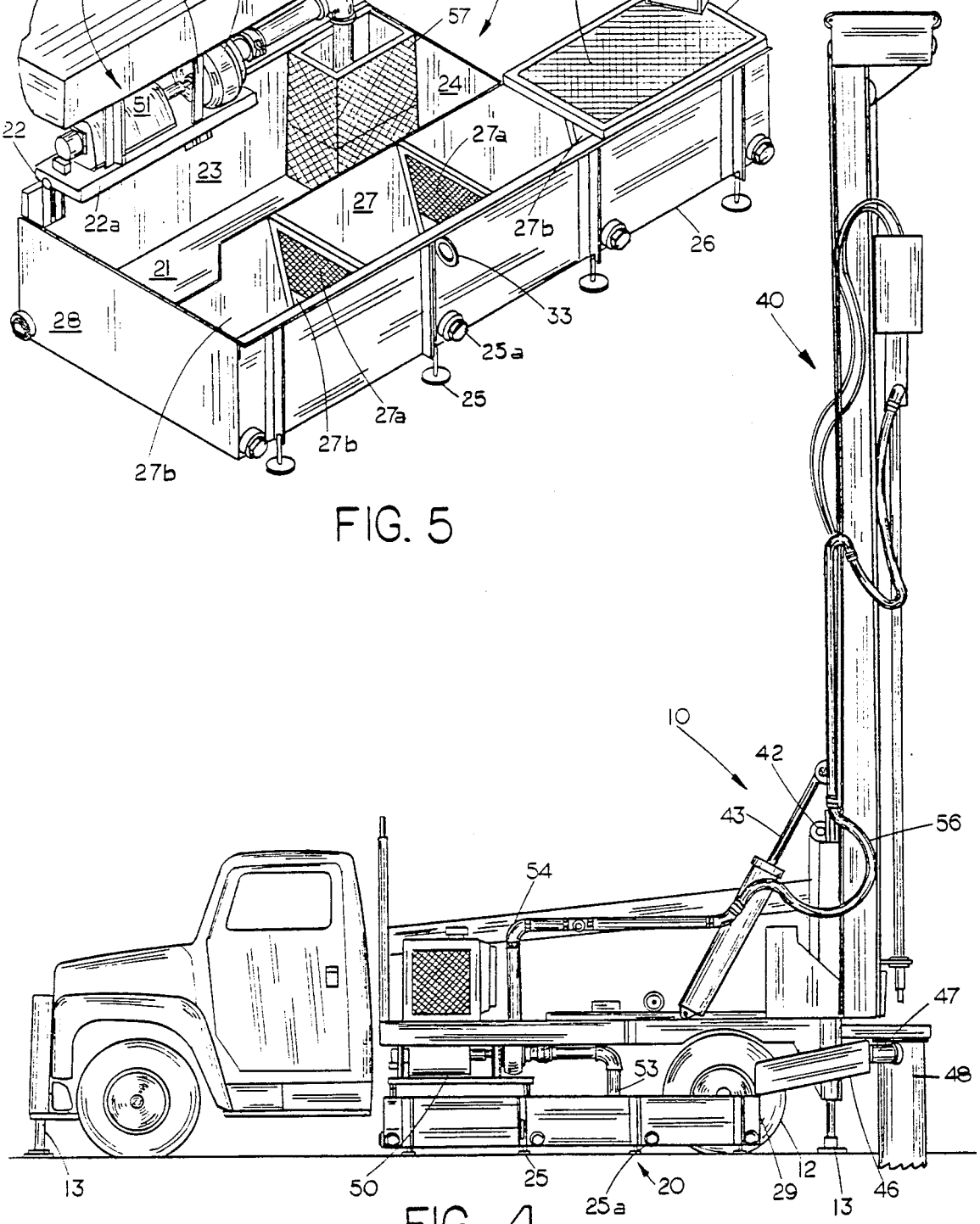
FIG. 4 is a side elevational view of the present invention showing the drill stem mast in the vertical, operational mode and the mud pit in the horizontal, operational mode.

The operation of vehicle-mounted earth drilling apparatus 10 after it has arrived at the location of a hole to be drilled and manuvered into an appropriate location relative to said hole, is initiated by stabilizing and leveling its deck 11 in a conventional manner by use of three point outrigger system 13 (see FIGS. 2 and 4). Latches (not shown) located at the forward and rearward ends of deck 11 are next unlatched in order to free the upper edges of wall panels 24 and 28 from deck 11. The mud pit assembly 20 is lowered by winch assembly 30 as explained hereinabove, intake pipe 53 is connected to pump 52, and corner screen 57 is located therearound within mud pit assembly 20.

After pulley 31 has been removed from mast 41, drill stem assembly 40 may then be pivoted to its vertical, operation position, rise pipe 48 put in place, and trough 46 along with flexible hose 47, located for transporting liquid from the top of riser pipe 48 to mud pit assembly 20.

Finally, pads 25 are adjusted to control the level of bottom panel 21 such that fluid will flow through mud pit assembly 20 in the direction of removable intake pipe 53.

After the hole has been drilled and mud pit assembly 20 emptied and cleaned, the operation described hereinabove is reversed, thereby returning vehicle-mounted earth drilling apparatus 10 to its storage-transport mode.

Accordingly, it is believed that all of the objects mentioned above are accomplished by the use of the best mode for carrying out the invention disclosed herein. Obviously, any modifications or variations of the present invention are possible in light of the above teachings; it is therefore to be understood that, within the scope of the appended claims, the invention may be practiced otherwise as specifically described.

I claim:

1. A vehicle-mounted earth drilling apparatus of the type having an elongated mast mounted on said vehicle for pivotal movement from a horizontal storage position to a vertical operating position and means for circulating a liquid from a mud pit, into a hollow drill stem which is supported by the mast, into the hole being drilled, and back to the mud pit, the improvement comprising means for conforming the mud pit into a substantially flat-bottomed container having substantially vertical walls which comprise a closed polygon; substantially horizontal hinge means connecting the upper edge of one wall of the mud pit to a portion of the vehicle frame which is above the ground a distance approximately equal to the height of the connected wall of the mud pit; and means for conveying the liquid from the hole being drilled to the mud pit.

2. The vehicle-mounted earth drilling apparatus of claim 1 wherein the conveying means is a portable trough extending from a riser surrounding the drill, at a slope, down to the upper edge of the rearward unhinged wall of the mud pit.

3. The vehicle-mounted earth drilling apparatus of claim 1, further comprising a means for winching the mud pit between a vertical transport position and a ground-supported operating position.

4. The vehicle-mounted earth drilling apparatus of claim 1, further comprising means for latching a point on the upper edge of at least one of the unhinged walls of the mud pit to a point on the vehicle frame adjacent thereto when the mud pit is in the vertical transport position.

5. The vehicle-mounted earth drilling apparatus of claim 1, wherein the hinge means is connected to the vehicle frame inboard from the side thereof a distance approximately equal to the height of the connected wall of the mud pit, thereby permitting portions of the vehicle and apparatus carried thereby to fit within the mud pit when it is in its vertical position.

6. The vehicle-mounted earth drilling apparatus of claim 5, wherein the circulating means includes a pump which is located within the mud pit when the mud pit is in the vertical position and is oriented so as to draw liquid from a point in the mud pit near the end of the path through which the liquid circulates through the mud pit.

7. The vehicle-mounted earth drilling apparatus of claim 6 further comprising a removable section of inlet pipe to convey liquid from the bottom of the mud pit to the pump intake whereby liquid can be conveyed from the bottom of the mud pit without having the intake to the pump in the way of the hinged wall of the mud pit when it is in the vertical position.

8. The vehicle-mounted earth drilling apparatus of claim 7 further comprising a removable screen means for enveloping the removable intake pipe within the mud pit, whereby rocks and the like will not be recirculated into the drill stem.

9. The vehicle-mounted earth drilling apparatus of claim 6 wherein the vehicle has a deck which is notched in front of the rear tire for the rearward wall of the mud pit when in the vertical position and the pump is suspended from said deck, further comprising a divider within the mud pit extending from the rear wall thereof to a point short of the opposite wall thereof and at a distance from the vehicle side which will locate the divider in a position substantially parallel to and slightly above the deck when the mud pit is in the vertical position and wherein the liquid conveying means delivers liquid to the mud pit at a point on the rearward wall thereof between the divider and the outer wall of the mud pit, whereby the pump will draw liquid from a point near the mud pit rear wall between the divider and the inner wall of the mud pit.

10. The vehicle-mounted earth drilling apparatus of claim 9 further comprising one or more divider screen means running between the divider and the opposing mud pit wall.

11. The vehicle-mounted earth drilling apparatus of claim 10 wherein the mud pit includes substantially rectangular first and second sections which together form an "L" shape, said first section including the hinged wall and said second section being rearward of the first section and joining it at a location which will result in it being above the rear tire of the vehicle when the mud pit is in the vertical position.

12. The vehicle-mounted earth drilling apparatus of claim 1, further comprising one or more low divider means of a height less than that of the wall panels of the mud pit, whereby separate settling compartments are created.

13. The vehicle-mounted earth drilling apparatus of claim 12, further comprising one or more divider screens, but in no event more than there are low divider means, each positioned on top of one of the low divider means.

14. The vehicle-mounted earth drilling apparatus of claim 1, wherein the portion of the vehicle frame to which the wall of said container is hinged is also inboard from the side of the vehicle a distance approximately equal to the height of said wall, thereby permitting portions of the vehicle and apparatus carried by it to fit within said container when it is in its vertical, transport-storage position.

15. The vehicle-mounted earth drilling apparatus of claim 14, wherein the recirculating means includes a pump which is located within said container when it is in the vertical position and is oriented so as to draw liquid at a point within the remaining portion of said container.

16. The vehicle-mounted earth drilling apparatus of claim 15, wherein the vehicle has a deck which is notched in front of the rear tire for the rearward wall of said container when in the vertical position, wherein the pump is suspended from said deck, wherein said means for forming a receiving and settling section includes a divider extending from the rearward wall of said container to a point short of the opposite wall thereof and at a distance from the vehicle side which will locate it in a position substantially parallel to and slightly above the deck when said container is in the vertical position; and wherein said recirculating means includes means for conveying the liquid plus solids from the hole being drilled to a point on the rearward wall of said container between its outer wall and the divider, whereby said pump will draw liquid from a point which is between the divider and inner wall and near the rearward wall of said container.

17. A vehicle-mounted earth drilling apparatus, comprising:

a hollow drill stem;

a substantially flat-bottomed, uncovered liquid container having substantially vertical walls, said container having means for forming one or more sections thereof for receiving a liquid carrying solids, permitting the solids to settle therein, and permitting the liquid to flow into the remaining portion of said container;

means for recirculating the liquid through a path comprising the remaining portion of said container, said hollow drill stem, the hole which is being bored thereby, and said receiving and settling section, as well as moving a portion of the solids carried from the hole by the liquid to said container;

means for horizontally hinging the upper edge of one wall of said container to a portion of the vehicle frame which is above the ground a distance approximately equal to the height of that wall of the container which is hinged to the vehicle frame; and means for operably maintaining said container in a vertical, transport-storage position.

* * * * *